US011344895B2

(12) United States Patent
Williamsson et al.

(10) Patent No.: US 11,344,895 B2
(45) Date of Patent: May 31, 2022

(54) PULSE FIRING PATTERN FOR A TRANSFORMER OF AN ELECTROSTATIC PRECIPITATOR AND ELECTROSTATIC PRECIPITATOR

(71) Applicant: General Electric Technology GmbH, Baden (CH)

(72) Inventors: Carl Marcus Williamsson, Ljungby (SE); Nanda Kishore Dash, Bhubaneswar Odisha (IN); Anders Nils Gustav Karlsson, Vaxjo (SE); Inger Elisabeth Önnerby Pettersson, Vaxjo (SE)

(73) Assignee: ANDRITZ AKTIEBOLAG, Ornskoldsvik (SE)

( * ) Notice: Subject to any disclaimer, the term of this patent is extended or adjusted under 35 U.S.C. 154(b) by 369 days.

(21) Appl. No.: 16/418,275

(22) Filed: May 21, 2019

(65) Prior Publication Data

US 2019/0270095 A1 Sep. 5, 2019

Related U.S. Application Data

(63) Continuation of application No. 15/184,205, filed on Jun. 16, 2016, now abandoned.

(30) Foreign Application Priority Data

Jun. 29, 2015 (IN) ..... 1922/DEL/2015

(51) Int. Cl.
*B03C 3/68* (2006.01)
*B03C 3/41* (2006.01)
(Continued)

(52) U.S. Cl.
CPC ..... *B03C 3/68* (2013.01); *B03C 3/41* (2013.01); *B03C 3/45* (2013.01)

(58) Field of Classification Search
CPC combination set(s) only.
See application file for complete search history.

(56) References Cited

U.S. PATENT DOCUMENTS 3,534,247 A 10/1970 Miljanic
3,873,282 A * 3/1975 Finch ..... B03C 3/68 96/22

(Continued)

FOREIGN PATENT DOCUMENTS

CN 2779702 Y 5/2006
CN 101075783 A 11/2007

(Continued)

OTHER PUBLICATIONS

N.Tachibana Y.Matsumoto; Intermittent energization on electrostatic precipitators, 1990; Journal of Electrostatics; vol. 25, Issue 1, Jun. 1990, pp. 55-73. (Year: 1990).*

(Continued)

*Primary Examiner* — Christopher P Jones
*Assistant Examiner* — Sonji Turner
(74) *Attorney, Agent, or Firm* — Grogan, Tuccillo & Vanderleeden, LLP

(57) ABSTRACT

The pulse firing pattern for a transformer of an electrostatic precipitator comprises first elements indicative of a pulse to be fired and second elements indicative of a pulse to not be fired. The pulse firing pattern further comprises couples of adjacent second elements and at least two first elements.

17 Claims, 2 Drawing Sheets

(51) Int. Cl.
*B03C 3/47* (2006.01)
*B03C 3/45* (2006.01)

(56) References Cited

U.S. PATENT DOCUMENTS 4,417,199 A * 11/1983 Jones ..... B03C 3/68 323/319
4,506,259 A 3/1985 Rhodes
4,521,228 A * 6/1985 Daar ..... B03C 3/68 96/19
4,587,475 A * 5/1986 Finney, Jr. ..... B03C 3/68 323/241
4,648,887 A 3/1987 Noda et al.
4,659,342 A * 4/1987 Lind ..... B03C 3/66 95/5
4,860,149 A * 8/1989 Johnston ..... B03C 3/68 361/79
5,068,811 A * 11/1991 Johnston ..... B03C 3/68 700/297
5,161,241 A 11/1992 Kanai
5,233,509 A 8/1993 Ghotbi
5,255,178 A * 10/1993 Liberati ..... B03C 3/68 323/903
5,352,930 A 10/1994 Ratz
5,515,262 A * 5/1996 Johnston ..... H02M 5/06 363/90
5,625,543 A 4/1997 Barrett
5,639,294 A * 6/1997 Ranstad ..... B03C 3/68 323/903
5,656,924 A 8/1997 Mohan et al.
5,705,923 A * 1/1998 Johnston ..... B03C 3/68 323/328
5,731,965 A 3/1998 Cheng et al.
6,040,689 A 3/2000 Gluszek
6,072,708 A 6/2000 Fischer
6,282,106 B2 * 8/2001 Grass ..... B03C 3/66 323/903
6,461,405 B2 * 10/2002 Reyes ..... B03C 3/68 95/7
6,611,440 B1 * 8/2003 Johnston ..... B03C 3/68 323/903
6,720,741 B2 4/2004 Crouse et al.
6,847,211 B1 1/2005 Muhitch et al.
6,861,897 B1 3/2005 Cheng et al.
7,269,038 B2 9/2007 Shekhawat et al.
7,649,753 B2 * 1/2010 Ranstad ..... B03C 3/66 363/21.02
7,701,732 B2 * 4/2010 Ranstad ..... H02M 7/10 363/17
9,132,434 B2 * 9/2015 Ranstad ..... B03C 3/025
9,325,300 B2 * 4/2016 Ranstad ..... H02M 7/493
9,331,561 B2 * 5/2016 Kolar ..... H02J 3/01
9,899,831 B2 * 2/2018 Ranstad ..... H02H 7/1216
2001/0011499 A1 8/2001 Reyes
2003/0227364 A1 12/2003 Li et al.
2009/0129124 A1 5/2009 Ranstad

FOREIGN PATENT DOCUMENTS

CN 103394412 A 11/2013
JP H06-71196 A 3/1994
WO 2009090165 A2 7/2009

OTHER PUBLICATIONS

Tachibana, N. and Matsumoto, Y., "Intermittent energization on electrostatic precipitator," 8266 Journal of Electrostatics, © 1990 Elsevier Science Publishers B.V., vol. 25, No. 1, Amsterdam, NL, Jun. 1990, pp. 55-73.
Extended European Search Report and Opinion issued in connection with corresponding EP Application No. 15180637.9 dated Nov. 7, 2016.
Hoadley F L, "Curb the disturbance", IEEE Industry Applications Magazine, IEEE Service Center, Piscataway, NJ, US, vol. 14, No. 5, Sep. 1, 2008, pp. 25-33, XP011233826.
"IEEE Recommended Practice for Powering and Grounding Electronic Equipment; IEEE Std 1100-1999)", IEEE Standard, IEEE, Piscataway, NJ, USA, May 24, 2006, pp. 213-214, XP002611028.
Green T C et al, "Control techniques for active power filters", IEE Proceeding: Electric Power Application, Institution Electrical Engineers, GB, vol. 152, No. 2, Oct. 25, 2004, pp. 369-381, XP006023694.
Lawhead L et al, "Three Phase Transformer Winding Configurations and Differential Relay Compensation", 60th Annual Georgia Tech Protective Relay Conference, May 2006.

* cited by examiner

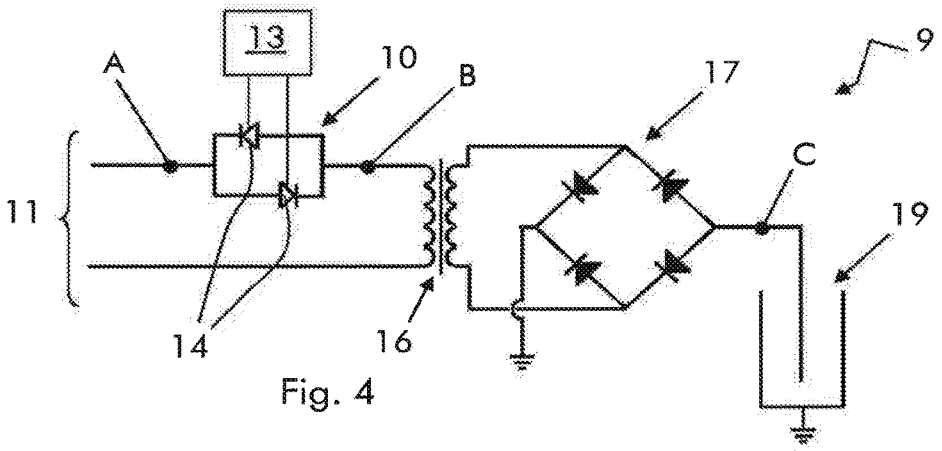
Fig. 4
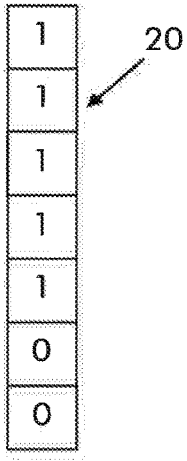
Fig. 5a
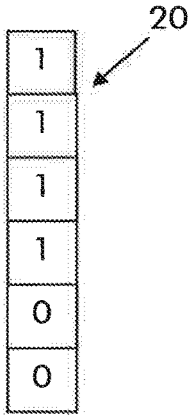
Fig. 5b
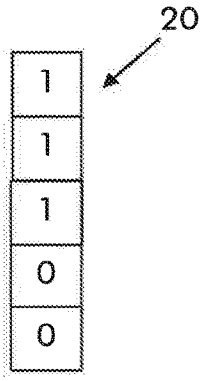
Fig. 5c
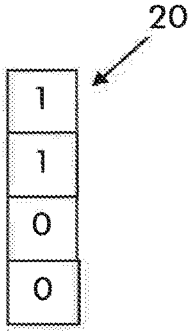
Fig. 5d
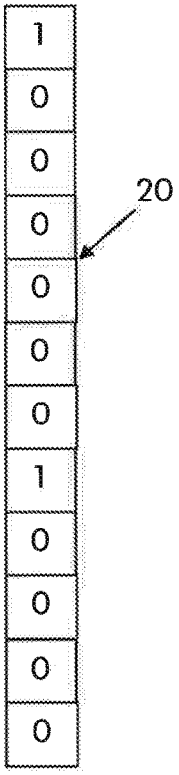
Fig. 5e
Fig. 6
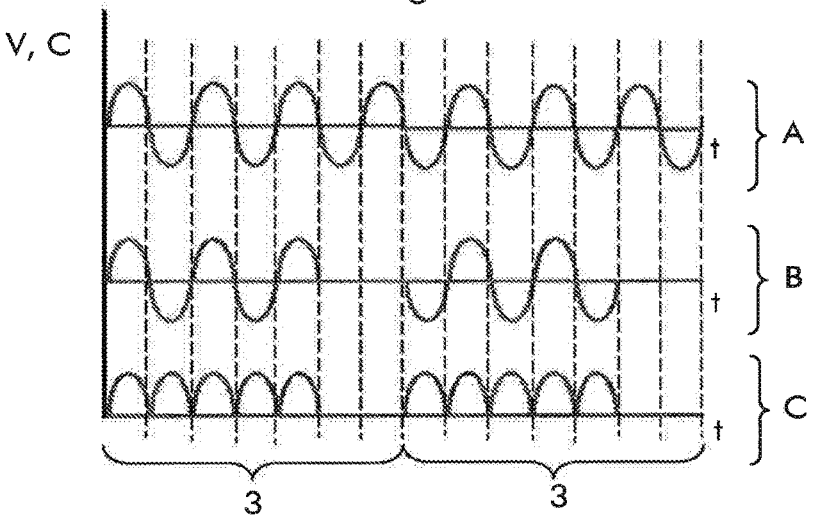

PULSE FIRING PATTERN FOR A TRANSFORMER OF AN ELECTROSTATIC PRECIPITATOR AND ELECTROSTATIC PRECIPITATOR

CROSS-REFERENCE TO RELATED APPLICATIONS

This Application is a continuation of U.S. patent application Ser. No. 15/184,205 filed Jun. 16, 2016, which claims priority to Indian Patent Application No. 1922/DEL/2015 filed Jun. 29, 2015, the contents of the foregoing being hereby incorporated in their entirety.

TECHNICAL FIELD

The present invention relates to a pulse firing pattern for a transformer of an electrostatic precipitator and electrostatic precipitator.

For example, the electrostatic precipitator is of the type used in a power plant or in an industrial application. Other applications with smaller electrostatic precipitators are anyhow possible.

BACKGROUND

Electrostatic precipitators are known to comprise a filter connected to a transformer in turn connected to a rectifier. Typically the transformer and the rectifier are embedded in one single unit. The filter is connected to a power supply, such as to the electric grid; the rectifier is in turn connected to collecting electrodes and discharge electrodes.

During operation the filter receives the electric power from the electric grid (e.g. this electric power can have sinusoidal voltage and current course) and skips some of the half waves of the electric power (e.g. voltage or current) according to a pulse firing pattern, generating a pulsed power that is supplied to the transformer.

The pulse firing pattern is a sequence of first elements indicative of a pulse to be fired and second elements indicative of a pulse to be not fired. The pulse firing pattern is defined as a pulse period or pulse firing pattern length having one first element and an even number of second elements; the pulse period thus has an odd number of elements.

If the transformer is supplied with a pulsed power having two or more successive pulses of the same polarity (i.e. positive or negative), this would cause a risk of saturation of the transformer. For this reason the pulse firing patterns traditionally used have one first element and an even number of second elements.

In addition, traditionally supply of pulsed power was only done to adapt the power sent to the collecting electrodes and discharge electrodes to the properties of the flue gas (e.g. in terms of resistivity), whereas energy management (to regulate the power sent to the collecting electrodes and discharge electrodes) was done by regulating the amplitude of the pulses.

Nevertheless, since when using pulse firing patterns only some but not all power from the electric grid is supplied to the collecting electrodes and discharge electrodes, the pulse firing patterns limit the power supplied to the collecting electrodes and discharge electrodes.

FIGS. 1, 2*a*, 2*b*, 3*a*, 3*b* show the voltage or current supplied to the transformer.

FIG. 1 shows the case when no pulse firing pattern is applied and all power from the electric grid is supplied to the transformer. In particular, reference 1 identifies the voltage or current supplied from the grid to the filter and reference 2 the voltage or current supplied from the filter to the transformer. In this case 100% of the power from the electric grid is supplied to the transformer and thus to the collecting electrodes and discharge electrodes.

FIG. 2*a* shows the case when the pulse firing pattern of FIG. 2*b* is applied at the filter and only ⅓ of the power from the electric grid is forwarded to the transformer, while ⅔ of the power from the electric grid is blocked at the filter and not supplied to the transformer. Also in this case, reference 1 identifies the voltage or current supplied from the grid to the filter and reference 2 the voltage or current supplied from the filter to the transformer. The curly brackets 3 identify the pulse period or pulse firing pattern length. In this case 33% of the power from the electric grid is supplied to the transformer and thus to the collecting electrodes and discharge electrodes.

FIG. 3*a* shows the case when the pulse firing pattern of FIG. 3*b* is applied and ⅕ of the power from the electric grid is forwarded to the transformer and ⅘ of the power from the electric grid is blocked at the filter and not supplied to the transformer. In this case as well, reference 1 identifies the voltage or current supplied from the grid to the filter, reference 2 the voltage or current supplied from the filter to the transformer and the curly brackets 3 identify the pulse period or pulse firing pattern length. In this case 20% of the power from the electric grid is supplied to the transformer and thus to the collecting electrodes and discharge electrodes.

It is thus apparent that the step between use of no pulse firing pattern (FIG. 1) and use of the pulse firing pattern that allows supply of the largest power to the collecting electrodes and discharge electrodes (FIG. 2*a*, 2*b*) corresponds to 67% of the power supplied from the electric grid.

This large power step could not allow optimal operation, because only in case the features of the gas being treated allow supply of the collecting electrodes and discharge electrodes with only 33% of the power supplied from the grid it is possible the use of pulse firing pattern; if use of 33% of the power from the grid is not possible in view of the features of the gas being treated, it is needed operation without pulse firing pattern. In other words, if the features of the gas could require use of a pulse firing pattern corresponding to e.g. 50% of the power from the electric grid, it is not possible operation with the pulse firing pattern, because use of the pulse firing pattern would allow supplying the collecting electrodes and discharge electrodes with only 33% of the power from the electric grid. It would thus be needed operation without pulse firing pattern.

In addition, power regulation made via amplitude reduction (of voltage and/or current), as traditionally done, affects the corona discharge from the discharge electrodes and thus negatively affects dust charging (that occurs via corona) and therefore dust collection at the collecting electrodes.

SUMMARY

An aspect of the invention includes providing a pulse firing pattern and an electrostatic precipitator that allow an improvement of the regulation of the power supplied to the collecting electrodes and discharge electrodes. Advantageously according to the invention fine regulation can be achieved.

These and further aspects are attained by providing a pulse firing pattern and an electrostatic precipitator in accordance with the accompanying claims.

Advantageously, amplitude regulation (voltage and/or current) is not needed for regulation, such that amplitude regulation does not affect or can be made to affect to a limited extent the corona discharge.

BRIEF DESCRIPTION OF THE DRAWINGS

Further characteristics and advantages will be more apparent from the description of a preferred but non-exclusive embodiment of the pulse firing pattern and electrostatic precipitator, illustrated by way of non-limiting example in the accompanying drawings, in which:

FIG. 4 shows an electrostatic precipitator;

FIGS. 5*a* through 5*e* show different examples of pulse firing patterns;

FIG. 6 shows the voltage or current at different positions of the electrostatic precipitator.

DETAILED DESCRIPTION

Figure 1:
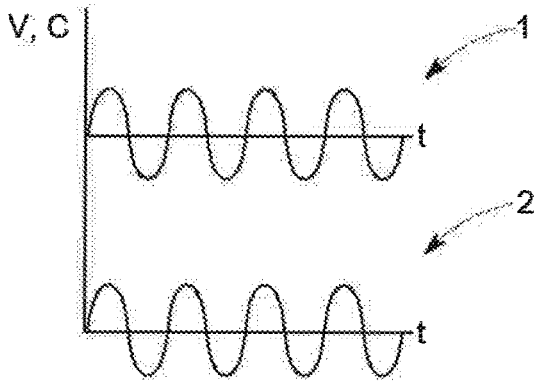
Fig. 1 (PRIOR ART)
FIG. 1 shows the voltage or current entering and moving out of a filter when no pulse firing pattern is used (prior art)
Figure 2A:
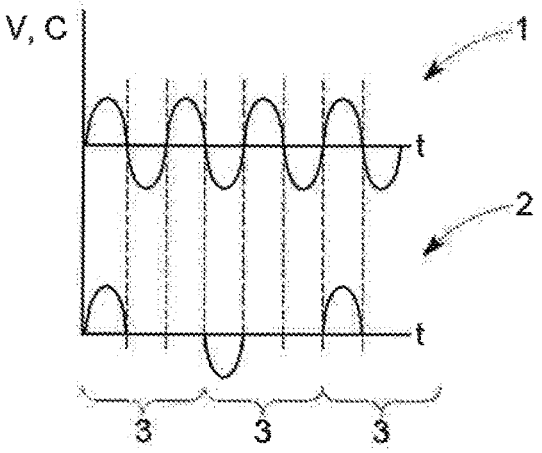
Fig. 2a (PRIOR ART)
FIG. 2*a* shows the voltage or current entering and moving out of a filter when the pulse firing pattern shown in FIG. 2*b* is used (prior art)
Figure 2B:
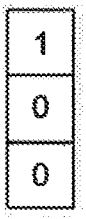
Fig. 2b (PRIOR ART)
FIG. 2*b* shows a pulse firing pattern (prior art)
Figure 3A:
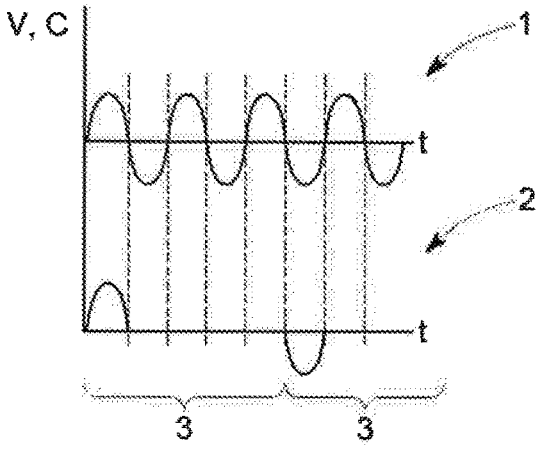
Fig. 3a (PRIOR ART)
FIG. 3*a* shows the voltage or current entering and moving out of a filter when the pulse firing pattern shown in FIG. 3*b* is used (prior art)
Figure 3B:
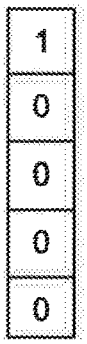
Fig. 3b (PRIOR ART)
FIG. 3*b* shows a pulse firing pattern (prior art)

In the following the electrostatic precipitator is described first.

The electrostatic precipitator 9 comprises a filter 10 connected to a power input 11; the filter 10 is arranged for filtering an input power from the power input 11, generating a pulsed power according to a pulse firing pattern.

A control unit 13 is connected to the filter 10 in order to drive it and implement the pulsed firing pattern. For example, the filter can comprise transistors or other types of electronic switches 14.

A transformer 16 is connected to the filter 10; the transformer 16 is arranged for transforming the pulsed power from the filter 10 into a transformed pulsed power.

A rectifier 17 is connected to the transformer 16; the rectifier 17 is arranged for rectifying the transformed pulsed power generating a rectified pulsed power.

Collecting electrodes and discharge electrodes 19 are connected to the rectifier 17 for receiving the rectified pulsed power. The collecting electrodes and discharge electrodes 19 are immersed in a path where the flue gas to be cleaned passes through.

The control unit 13 implements the pulse firing pattern, i.e. drives the electronic switches 14 to pass to an electric conductive state or electric non-conductive state according to the pulsed firing pattern.

FIGS. 5*a* through 5*e* show some possible pulse firing patterns 20, namely:

FIG. 5*a* shows a pulse firing pattern 20 that allows to transfer 71% of the power from the power input 11 to the transformer 16 and thus to the collecting electrodes and discharge electrodes 19;

FIG. 5*b* shows a pulse firing pattern that allows to transfer 67% of the power from the power input 11 to the transformer 16 and thus to the collecting electrodes and discharge electrodes 19;

FIG. 5*c* shows a pulse firing pattern that allows to transfer 60% of the power from the power input 11 to the transformer 16 and thus to the collecting electrodes and discharge electrodes 19;

FIG. 5*d* shows a pulse firing pattern that allows to transfer 50% of the power from the power input 11 to the transformer 16 and thus to the collecting electrodes and discharge electrodes 19;

FIG. 5*e* shows a pulse firing pattern that allows to transfer 17% of the power from the power input 11 to the transformer 16 and thus to the collecting electrodes and discharge electrodes 19.

Even if only few examples are given above, it is clear that the pulse firing pattern 20 according to the invention can allow to transfer any power from the power input 11 to the transformer 16 and thus to the collecting electrodes and discharge electrodes 19. The pulse firing pattern 20 comprises:

first elements indicative of a pulse to be fired; these elements are indicated as "1" in the attached figures;

second elements indicative of a pulse to not be fired, these elements are indicated as "0" in the attached figures.

For example the pulse firing pattern can have less than 20, or less than 1000 or at least 1000 or at least 10000 elements between the first elements and the second elements.

The pulse firing pattern 20 comprises couples of adjacent second elements "0" (i.e. an even number of adjacent elements "0") and at least two first elements "1".

In the following an example of operation using a pulse firing pattern of FIG. 5*a* is described. FIG. 6 shows the voltage or power at different positions A, B, C of the electrostatic precipitator 9.

The power input 11 (e.g. electric grid) supplies electric power whose voltage or current has e.g. sinusoidal course (FIG. 6, position A). At the filter 10 only the half waves in correspondence of a "1" of the pulsed firing pattern 20 are allowed to pass through, whereas half waves in correspondence of "0" of the pulse firing pattern 20 are blocked.

FIG. 6, position B shows the voltage or current downstream of the filter 10 and upstream of the transformer 16.

After the transformer, the electric power is rectified at the rectifier 17; FIG. 6, position C shows the voltage or current downstream of the rectifier 17.

Implementation of the pulse firing pattern 20 in an electrostatic precipitator 9 allows supply of any power to the collecting electrodes and discharge electrodes 19, but the transformer 16 is not supplied with successive pulses of the same sign such that no saturation of the transformer occurs.

One way of defining a pulse firing pattern allowing to transfer to the collecting electrodes and discharge electrodes a desired or required power can comprise:

a) defining a target parameter indicative of the power to be supplied to the collecting electrodes and discharge electrodes 19;

b) calculating a first parameter indicative of the power supplied to the collecting electrodes and discharge electrodes 19 using the pulse firing pattern being calculated, in case one additional pulse is fired, c) calculating a second parameter indicative of the power supplied to the collecting electrodes and discharge electrodes 19 using the pulse firing pattern being calculated, in case two additional successive pulses are not fired, d) selecting pattern elements between one first element or two second elements on the basis of the first parameter or second parameter, e) repeating steps b), c), d), e).

Selecting pattern elements can be done:

on the basis of which parameter between the first parameter or second parameter falls closer to the target parameter or, in case this is not possible, because e.g. none of the first parameter or second parameter falls closer to the target parameter (e.g. the first parameter and second parameter have the same distance from the target parameter)

a given pattern element can be selected; e.g. in this case the pattern element "1" could be selected; alternatively it is also possible to select the pattern element "0".

As for the step e), it is also possible that the step e) also comprises repeating the step a) in addition to repeating steps b) though e). This embodiment of the method thus preferably comprises a continuous calculation of the pulse firing pattern, and the target parameter can be supplied to e.g. the control unit 13 in any moment, such that the continuous calculation allows to have a pulse firing pattern allowing a power transfer to the collecting electrodes and discharge electrodes 19 always moving towards the target parameter.

The continuous repetition can be implemented by defining a pattern period or pulse firing pattern length and calculating the first parameter and the second parameter on the basis of the pattern period or pulse firing pattern length.

For example, a start and an end can be defined in the pulse firing pattern; the start correspond to the element added first to the pulse firing pattern and the end to the element added last to the pulse firing pattern, i.e. the additional elements are added to the end of the pulse firing pattern.

Thus, calculating the first parameter and the second parameter on the basis of the pattern period can comprise:

calculating the first parameter indicative of the power supplied to the electrostatic precipitator using a pulse firing pattern having the pulse period or pulse firing pattern length, and one additional first element, and deprived of one element at the start;

calculating a second parameter indicative of the power supplied to the electrostatic precipitator using a pulse firing pattern having the pulse period, and two additional second elements, and deprived of two elements at the start.

Naturally continuous calculation (implementing by the feature e) above) can also be implemented without repeating the step a).

As an alternative, it is also possible discontinuation of the Step e) can be achieved when the first parameter or second parameter becomes equal to the target parameter or when the first parameter and second parameter depart from the target parameter. In this case once one or more pulse firing patterns are calculated, they can be implemented in the electrostatic precipitator, for example different pulse firing patterns can be defined for different flue gas features and power required at the collecting electrodes and discharge electrodes 19.

The control unit 13 implements the pulsed firing pattern 20 and preferably has a computer readable memory medium containing instructions to implement the method.

Naturally the features described may be independently provided from one another.

What is claimed is:

1. An electrostatic precipitator, comprising:

a power input operative to provide electrical power;

a filter in electronic communication with the power input to filter the power input and generate a pulsed electrical power, the filter including a pair of switches electrically connected to the power input;

a transformer electrically connected to the filter to transform the pulsed electrical power;

a rectifier electrically connected to the transformer to rectify the transformed pulsed electrical power;

one or more collecting electrodes and one or more discharge electrodes electrically connected to the rectifier, each of the collecting electrodes and discharge electrodes operative to receive the rectified pulsed electrical power; and a controller electrically connected to the filter to control an amount of the electrical power that is transferred from the filter to the one or more collecting electrodes and the one or more discharge electrodes via the transformer and the rectifier based at least in part on a pulse firing pattern;

wherein the pulse firing pattern includes at least two first pattern elements indicative of the electrical power being pulsed on and a plurality of second pattern elements indicative of the electrical power not being pulsed on, the first pattern elements and the second pattern elements defining a target amount of the electrical power that is to be transferred from the filter to the one or more collecting electrodes and the one or more discharge electrodes, and wherein the controller uses the pulse firing pattern to drive the switches of the filter to an electric conductive state or an electric non-conductive state in a manner that transfers the electrical power from the filter to the one or more collecting electrodes and the one or more discharge electrodes towards an amount that corresponds with the target amount defined by the pulse firing pattern.

2. The electrostatic precipitator of claim 1, wherein the pulse firing pattern further includes at least 1,000 pattern elements between the at least two first pattern elements and the plurality of second pattern elements.

3. The electrostatic precipitator of claim 1, wherein the pulse firing pattern further includes at least 10,000 pattern elements between the at least two first pattern elements and the plurality of second pattern elements.

4. The electrostatic precipitator of claim 1, wherein the pulse firing pattern further includes at least 20 pattern elements between the at least two first pattern elements and the plurality of second pattern elements.

5. The electrostatic precipitator of claim 1, wherein the one or more collecting electrodes and the one or more discharge electrodes are disposed in the path of a flue gas and are further operative to clean the flue gas based at least in part on the received pulsed electrical power.

6. A method of cleaning a flue gas via an electrostatic precipitator having a filter that receives electrical power from a power input, a transformer, a rectifier, one or more collecting and discharge electrodes disposed in the path of the flue gas, and a controller to control an amount of the electrical power transferred from the filter to the one or more collecting electrodes and discharge electrodes via the transformer and the rectifier, the method comprising:

pulsing the electrical power from the filter to the one or more collecting electrodes and discharge electrodes via the transformer and the rectifier; and controlling via the controller an amount of the electrical power that is transferred from the filter to the one or more collecting electrodes and discharge based at least in part on a pulse firing pattern;

wherein the pulse firing pattern comprises a combination of first pattern elements indicative of a pulse to be fired and second pattern elements indicative of a pulse to be not fired, the combination of first pattern elements and the second pattern elements in the pulse firing pattern defining a target amount of the electrical power that is to be transferred from the filter to the one or more collecting electrodes and the one or more discharge electrodes, wherein the combination of the first pattern elements and the second pattern elements in the pulse firing pattern includes at least two first elements and a plurality of second elements, and wherein the controller uses the pulse firing pattern to drive a pair of switches of the filter that are electrically connected to the power input to an electric conductive state or an electric non-conductive state in a manner that transfers the electrical power from the filter to the one or more collecting electrodes and electrodes towards an amount that corresponds with the target amount defined by the pulse firing pattern.

7. The method of claim 6, wherein the pulse firing pattern further includes at least 1,000 pattern elements between the at least two first pattern elements and the plurality of second pattern elements.

8. The method of claim 6, wherein the pulse firing pattern further includes at least 10,000 pattern elements between the at least two first pattern elements and the plurality of second pattern elements.

9. The method of claim 6, wherein the pulse firing pattern further includes at least 20 pattern elements between the at least two first pattern elements and the plurality of second pattern elements.

10. The method of claim 6, further comprising:

transforming the pulsed electrical power via the transformer prior to being received by the one or more collecting and discharge electrodes.

11. The method of claim 6, further comprising:

rectifying the pulsed electrical power via the rectifier prior to being received by the one or more collecting and discharge electrodes.

12. A non-transitory computer readable medium comprising instructions that adapt a controller to:

pulse electrical power via a filter, a transformer electrically connected to the filter, and a rectifier electrically connected to the transformer to one or more collecting electrodes and discharge electrodes electrically connected to the rectifier that are disposed in the path of a flue gas; and control an amount of the electrical power that is transferred from the filter to the one or more collecting electrodes and discharge electrodes via the transformer and the rectifier based at least in part on a pulse firing pattern;

wherein the pulse firing pattern comprises a combination of first pattern elements indicative of a pulse to be fired and second pattern elements indicative of a pulse to be not fired, the combination of first pattern elements and the second pattern elements in the pulse firing pattern defining a target amount of the electrical power that is to be transferred from the filter to the one or more collecting electrodes and the one or more discharge electrodes, wherein the combination of the first pattern elements and the second pattern elements in the pulse firing pattern includes at least two first elements and a plurality of second elements, and wherein the controller uses the pulse firing pattern to drive a pair of switches of the filter that are electrically connected to the power input to an electric conductive state or an electric non-conductive state in a manner that transfers the electrical power from the filter to the one or more collecting electrodes and electrodes towards an amount that corresponds with the target amount defined by the pulse firing pattern.

13. The non-transitory computer readable medium of claim 12, wherein the pulse firing pattern further includes at least 1,000 pattern elements between the at least two first pattern elements and the plurality of second pattern elements.

14. The non-transitory computer readable medium of claim 12, wherein the pulse firing pattern further includes at least 10,000 pattern elements between the at least two first pattern elements and the plurality of second pattern elements.

15. The non-transitory computer readable medium of claim 12, wherein the pulse firing pattern further includes at least 20 pattern elements between the at least two first pattern elements and the plurality of second pattern elements.

16. The electrostatic precipitator of claim 1, wherein the pulse firing pattern comprises couples of adjacent second pattern elements and at least two first pattern elements.

17. The electrostatic precipitator of claim 16, wherein the adjacent second pattern elements comprises an even number of adjacent second pattern elements.

* * * * *